US006021821A

United States Patent [19]

Wegman

[11] Patent Number: 6,021,821

[45] Date of Patent: Feb. 8, 2000

[54] PARTICULATE PROCESSING APPARATUS

[75] Inventor: Paul M. Wegman, Pittsford, N.Y.

[73] Assignee: Xerox Corporation, Stamford, Conn.

[21] Appl. No.: 09/173,395

[22] Filed: Oct. 15, 1998

[51] Int. Cl.[7] ..... B65B 1/04

[52] U.S. Cl. ..... 141/93; 141/2; 141/65; 141/67; 141/129; 141/250; 141/256; 141/286; 366/100; 366/102; 366/133; 366/156.1

[58] Field of Search ..... 141/2, 4, 5, 7, 141/8, 11, 12, 59, 65, 67, 93, 129, 250, 256, 286; 366/101, 102, 133, 156.1

[56] References Cited

U.S. PATENT DOCUMENTS

| | | | |
|---|---|---|---|
| 2,791,355 | 5/1957 | Morgan, Jr. | 222/411 |
| 4,492,294 | 1/1985 | Ball | 141/93 |
| 5,226,863 | 7/1993 | Kimura | 141/8 |
| 5,499,749 | 3/1996 | Conant | 222/233 |
| 5,598,876 | 2/1997 | Zanini et al. | 141/93 |

*Primary Examiner*—Steven O. Douglas
*Assistant Examiner*—Timothy L. Maust
*Attorney, Agent, or Firm*—John L. Haack

[57] ABSTRACT

An apparatus including: a conduit operably connected to a source and extending downwardly therefrom, the conduit being adapted to permit a flow of particulate material from the source through the conduit; a fluidizing nozzle operably connected to the conduit and extending downwardly therefrom, the nozzle defining an inlet for receiving material from the conduit and defining an outlet for dispensing material from the nozzle to a receiver, the inlet defining an inlet cross sectional area perpendicular to the flow of the material and outlet defining an outlet cross sectional area perpendicular to the flow of the material, the inlet cross sectional area being larger than the outlet cross sectional area; the nozzle being adapted with a plenum including an inlet port for receiving compressed gas and a chamber adapted to communicate the gas to the porous walls of the nozzle, and an outlet port for engaging a vacuum source to continuously evacuate the receiver while the nozzle is engaged with the receiver; a conveyor located at least partially within the conduit, the conveyor assisting the flow of material from the source to the receiver; and a liner member residing on to at least a portion of the inner surface of the conduit and adjacent to the nozzle.

21 Claims, 2 Drawing Sheets

PARTICULATE PROCESSING APPARATUS

CROSS REFERENCE TO COPENDING APPLICATIONS AND RELATED PATENTS

Attention is directed to commonly owned and assigned U.S. Pat. No. 5,685,348, issued Nov. 11, 1997, entitled "ELECTROMAGNETIC FILLER FOR TONER"; and U.S. Pat. No. 5,699,842, issued Dec. 23, 1997, entitled "MAGNETIC FILLING AND MIXING APPARATUS AND PROCESSES THEREOF".

Attention is directed to commonly assigned copending applications: U.S. Ser. No. 09/061,122, filed Apr. 16, 1998, entitled "APPARATUS FOR PARTICULATE PROCESSING" which discloses an apparatus including a funnel comprising a housing operably connected to a particulate source at one end and extending downwardly therefrom to a receiver member at the other end, the funnel being adapted to permit a flow of powder therethrough, and wherein the inner wall of the funnel is adapted with a porous member which provides a boundary layer of gas between the porous member and the powder; U.S. Ser. No. 08/923,016, now U.S. Pat. No. 5,921,295, filed Sep. 3, 1997, "HIGH SPEED NOZZLE FOR TONER FILLING" which discloses an apparatus for assisting in filling a container from a hopper containing a supply of powder and includes a conduit operably connected to the hopper and extending downwardly therefrom, wherein the conduit is adapted to permit a flow of powder therewithin; U.S. Ser. No. 09/039,804, filed Mar. 16, 1998, "APPARATUS FOR PARTICULATE PROCESSING" which discloses a method including: a particulate material source and receiver, and wherein the source contains a discharge feature; moving material in the source in the direction of a member located at least partially within the source, the member defining an adjustable restriction therein such that the particulate material clogs within the restriction; mechanically agitating the particulate material in the source, at least adjacent to the restriction to thereby unclog the particulate material within the adjustable restriction; and dispensing particulate material through the adjustable restriction, through the discharge feature, and into the receiver; U.S. Ser. No. 08/829,925, now U.S. Pat. No. 5,947,169, filed Apr. 1, 1997, entitled "OSCILLATING VALVE FOR POWDERS" which discloses a method for filling a powder container with a supply of powder in a vessel, comprising: placing a first powder container to be filled in filling relationship to a discharge feature in the vessel; directing the powder in the vessel toward a member located at least partially within the vessel, the member defining a restriction therein such that the powder clogs within the restriction; mechanically exciting the powder at least adjacent the restriction to improve the flow properties of the powder so as to unclog the powder within the restriction; dispensing powder through the restriction, through the discharge feature and into the first container; stopping the mechanical excitation of the powder so as to clog the restriction with the powder; removing the first container from the vessel; and placing a second container to be filled in filling relationship to the vessel; U.S. Ser. No. 08/823,034, now U.S. Pat. No. 5,909,829, filed Apr. 1, 1997 entitled "TONER VIBRO-CONDITIONING SYSTEM FOR AUGERLESS FILLERS", which discloses a method for filling a powder container, comprising: placing a first powder container to be filled in filling relationship to a supply of powder in a vessel; mechanically exciting the powder in the vessel to improve its flow properties; dispensing powder from the vessel into the first container; removing the first container from the vessel; and placing a second container to be filled in filling relationship to the vessel; U.S. Ser. No. 08/540,993, now U.S. Pat. No. 5,839,458, filed Oct. 12, 1995, <entitled "ELECTROMAGNETIC VALVE AND DEMAGNETIZING CIRCUIT" which discloses a method for controlling filling a container, comprising: placing a first container to be filled in filling relationship to a fill tube; moving a magnetic material from a source thereof through the fill tube to fill the first container with the material; applying a magnetic force to the material in the fill tube once the first container is filled, the magnetic force being sufficient to hold the material in place in the fill tube; removing the first container; placing a second container to be filled in filling relationship to the fill tube; and removing the magnetic force applied to the material so that the material can move through the fill tube and into the second container; and U.S. Ser. No. 09/173,415, filed concurrently herewith on Oct. 15, 1998, entitled "PARTICULATE PROCESSING APPARATUS."

The disclosures of each of the above mentioned patents and copending applications are incorporated herein by reference in their entirety. The appropriate components and processes of these patents may be selected for the toners and processes of the present invention in embodiments thereof.

BACKGROUND OF THE INVENTION

This invention relates generally to apparatus and method for controllably and accurately dispensing particulate materials. More specifically the invention concerns reliably dispensing particulate materials from a source container to subsequent unit operation process equipment, for example, receiving receptacles on a fill line conveyor for receiving particulates such as toner from a supply hopper through a particulate conveyor to a toner container, or a melt mixing or extruder device. The invention is accomplished with a high speed filling nozzle assembly which has a fluidizing compression nozzle and conduit lined with a low surface tension material to provide enhanced flow properties to the particulate materials. Non magnetic particles, magnetic particles, and mixtures thereof can be selected for processing with the high speed filling nozzle apparatus of the present invention. In embodiments the high speed filling apparatus of the present invention includes a fluidizing nozzle with gas fluidized walls, and a low surface tension liner material which assists in the transport of particulates from the source to the nozzle. The assembly provides exceptionally high fill rates, fill densities, fill accuracies, and clean, non-dribble operation. The nozzle assembly provides for smooth, continuous flow, and high throughput of particulate materials. The low-friction low-surface tension "non-stick" liner material ensures continuous and non-blocking flow of particulate materials through the filling assembly enabling smooth delivery of material and trouble free operation of the filling apparatus.

The apparatus and method of the present invention solves important filling problems and provides various advantages including: greatly reduced time required to fill particulate receiving vessels in an interruptible yet continuous manner; and reduced leakage and concomitant contamination arising from continuous high speed fill operations.

In the aforementioned copending application U.S. Ser. No. 08/923,016, now U.S. Pat. No. 5,921,295, there is disclosed an apparatus for assisting in filling a container from a hopper containing a supply of powder and includes a low friction compression nozzle.

The apparatus comprises:

a conduit operably connected to the hopper and extending downwardly therefrom, the conduit adapted to permit a flow of powder therewithin;

a nozzle operably connected to the conduit and extending downwardly therefrom, the nozzle defining an inlet thereof for receiving powder from the conduit and defining an outlet thereof for dispensing powder from the nozzle to the container, the inlet defining an inlet cross sectional area perpendicular to the flow the powder and outlet defining an outlet cross sectional area perpendicular to the flow the powder, the inlet cross sectional area being larger than the outlet cross sectional area; and a conveyor located at least partially within the conduit, the conveyor assisting to provide the flow of powder from the container, wherein the dimensions of the nozzle are selected so as to provide a ratio of the inlet cross sectional area to the outlet cross sectional area such that the flow of powder does not seize as it progresses through the nozzle.

In the aforementioned copending application U.S. Ser. No. 08/540,993, now U.S. Pat. No. 5,839,458, there is disclosed a container filling method for controllably filling a container, and includes:

placing a first container to be filled in filling relationship to a fill tube;

moving a magnetic material from a source thereof through the fill tube to fill the first container with the material;

applying a magnetic force to the material in the fill tube once the first container is filled, the magnetic force being sufficient to hold the material in place in the fill tube;

removing the first container;

placing a second container to be filled in filling relationship to the fill tube; and removing the magnetic force applied to the material so that the material can move through the fill tube and into the second container.

The aforementioned copending applications are incorporated by reference herein in their entirety.

Toner containers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely fill the remote portions of the container before the container is full.

The problems associated with controlling the filling of toner containers are largely attributable to the properties of the toner. Toner is the image-forming material in a developer which when deposited by the field of an electrostatic charge becomes the visible record. There are two different types of developing systems known as one-component and two-component systems. In onecomponent developing systems, the developer material is toner comprised of particles of magnetic material, usually iron, embedded in a black plastic resin. The iron enables the toner to be magnetically charged. In two-component systems, the developer material is comprised of toner of polymer or resin particles and a colorant, and a carrier of roughly spherical particles or beads usually made of steel. An electrostatic charge between the toner and the carrier bead causes the toner to cling to the carrier in the development process. Control of the flow of these small, abrasive and easily charged particles is very difficult. The one-component and two-component systems utilize toner that is very difficult to flow. This is particularly true of the toner used in two component systems. The toner tends to cake and bridge within the hopper. This limits the flow of toner through the small tubes which are required for addition of the toner through the opening of the toner container. Also, this tendency to cake and bridge may cause air gaps to form in the container resulting in incorrect or partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to cloud causing dirt to contaminate the ambient air and to accumulate around the filling operation.

Also, difficulties have occurred in quickly starting and stopping the flow of toner from the hopper when filling the container with toner in a high speed production filling operation. An electromagnetic toner valve has been developed as described in the aforementioned copending U.S. patent application Ser. No. 08/540,993 and U.S. Pat. No. 5,685,348, the disclosures of which are incorporated herein by reference in their entirety.

SUMMARY OF THE INVENTION

Embodiments of the present invention, include:

Overcoming or minimizing problems encountered in the art by providing particulate handling and filling equipment, which enables improved manufacturing efficiency and material throughput;

An apparatus comprising:

a conduit operably connected to a source and extending downwardly therefrom, the conduit being adapted to permit a flow of particulate material from the source through the conduit;

a fluidizing nozzle operably connected to the conduit and extending downwardly therefrom, the nozzle defining an inlet for receiving material from the conduit and defining an outlet for dispensing material from the nozzle to a receiver, the inlet defining an inlet cross sectional area perpendicular to the flow of the material and outlet defining an outlet cross sectional area perpendicular to the flow of the material, the inlet cross sectional area being larger than the outlet cross sectional area; the nozzle being adapted with a plenum including an inlet port for receiving compressed gas and a chamber adapted to communicate the gas to the porous walls of the nozzle, and an outlet port for engaging a vacuum source to continuously evacuate the receiver while the nozzle is engaged with the receiver;

a conveyor located at least partially within said conduit, the conveyor assisting the flow of material from the source to the receiver; and a liner member residing on to at least a portion of the inner surface of said conduit and adjacent to said nozzle;

A method comprising:

placing a first container to be filled in filling relationship with the nozzle of the aforementioned apparatus;

rotating the conveyor thereby driving the particulate material from a two source through the conduit to fill the first container with particulate material;

stopping the conveyor thereby stopping the flow of particulate material through the apparatus when the first container is filled to a predetermined value;

removing the first container; and repeating continuously the sequence of placing, rotating, stopping, and removing the filled container with an n-th container.

These and other aspects are achieved, in embodiments, of the present invention as described and illustrated herein.

DETAILED DESCRIPTION OF THE INVENTION

Figure 1:
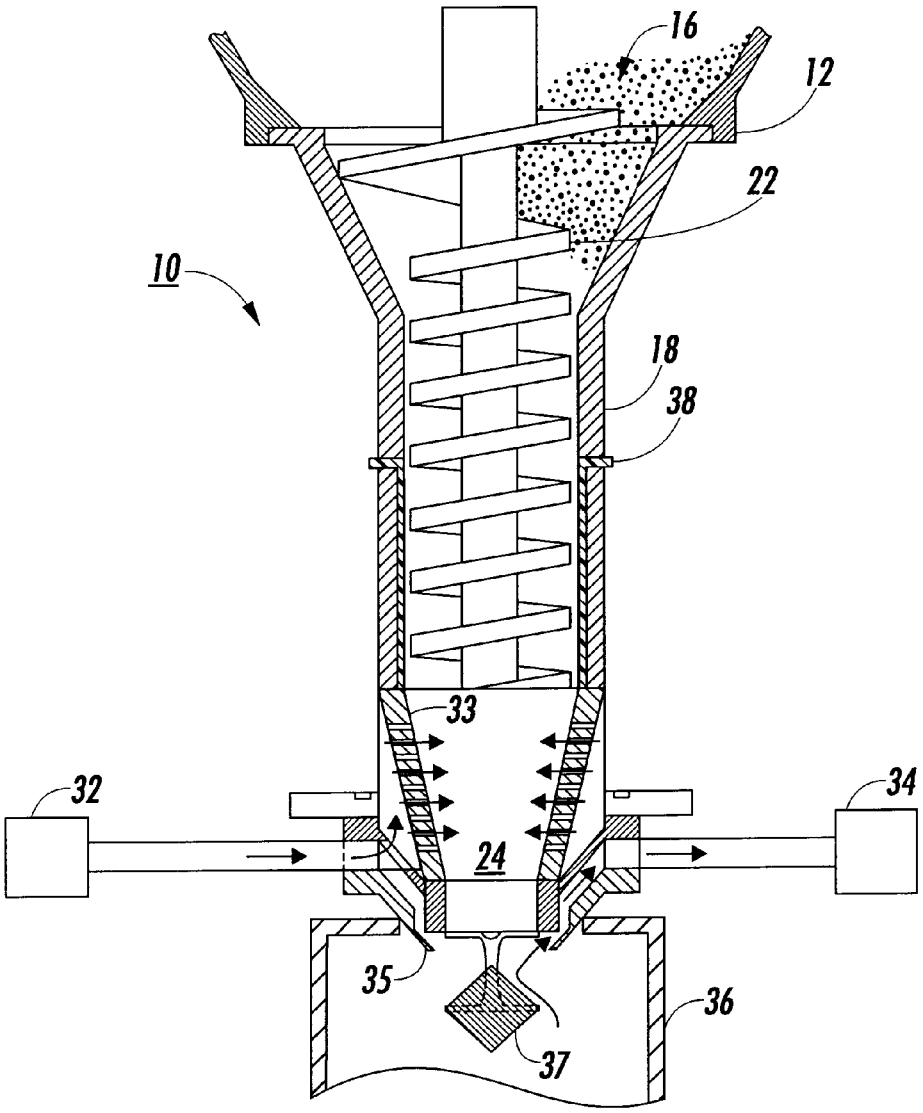
FIG. 1 is a cross-section of an exemplary filling system incorporating the high speed filling apparatus of the present invention showing attachment to a material source hopper, conduit, auger conveyor, fluidizing compression nozzle, low friction sleeve liner, and a receiver.

The present invention provides an apparatus comprising:

a conduit, for example a transport tube or funnel, operably connected to a source such as a detachable or interchangeable hopper, and extending downwardly therefrom, the conduit is adapted to permit a flow of particulate material, such as magnetic or non magnetic powder, from the source through the conduit;

a fluidizing nozzle, herein referred to as a fluidizing compression nozzle, operably connected to the conduit and extending downwardly therefrom, the nozzle defining an inlet for receiving material from the conduit and defining an outlet for dispensing material from the nozzle to a receiver, for example a container, cartridge, bottle, and the like, or processing equipment, such as an extruder and the like receivers, the inlet defining an inlet cross sectional area perpendicular to the flow of material and an outlet defining an outlet cross sectional area perpendicular to the flow of material, the inlet cross sectional area being larger than the outlet cross sectional area; the nozzle is adapted with a plenum including an inlet port for receiving compressed gas and a chamber adapted to communicate the gas to the porous walls of the nozzle, and an outlet port for engaging a vacuum source to continuously evacuate the receiver while the nozzle is engaged with the receiver;

a conveyor located at least partially within the conduit, the conveyor assisting the flow of material from the source to the receiver; and a liner member residing on to at least a portion of the inner surface of the conduit and adjacent to the nozzle.

The liner provides anti-dribble or leak prevention character to the apparatus to the extent that when the conveyor auger is stopped there is little if any adhesive force associated with the area of the conduit walls that is covered by the liner member so that particulate material in that region readily purges or falls under the influence of gravity, gas fluidization forces, and negative vacuum pressure in the receiver, into the fluidized nozzle region and thereafter into the receiver. In embodiments, if desired, the extent of purging provided by the liner member can be modified by changing surface tension or frictional characteristics of the liner material. When the auger conveyor is stopped particulate material above the lined region typically seizes or blocks due compaction forces with the effect of producing a natural valving action. When the auger conveyor is restarted the seizing or blocking rapidly dissipates and reestablishes a smooth particulate flow.

The dimensions of the nozzle are selected so as to provide a ratio of the inlet cross sectional area to the outlet cross sectional area such that the flow of material does not seize as it progresses through the apparatus in conjunction with the operation of the auger, liner, and fluidizing nozzle.

In embodiments the particulate material can be non-magnetic, magnetic, and mixtures thereof, such as a toner including a resin and a colorant, such as magnetite, and which toner particles have an average particle size of from about 2 to about 50 microns. The particulate material can also be a developer material including a mixture of magnetic or non-magnetic toner particles and magnetic or non-magnetic carrier particles.

At least a portion of inner surface of the conduit is coated or lined with a material having a low coefficient of friction, that is a liner or coating having at least an outer surface that contacts the particulate material, with a coefficient of friction of from about 0.10 to about 0.25. Examples of preferred liners are polytetrafluoroethylene, nylon, and the like low or non-stick materials. In a preferred embodiment a low friction sleeve, liner, or coating, resides on at least a portion of the inner surface of the conduit and adjacent to the nozzle. It will be appreciated that in embodiments the entire conduit can be lined with a low friction material, or alternatively, the conduit itself can be constructed of a low friction material in lieu of a low friction liner material.

The plenum includes an inlet port for receiving compressed gas into a chamber adapted to further communicate the gas to porous regions of the walls of the nozzle thereby providing additional fluidization of the particulate material. The gas pressure can be, for example, from about 20 to about 60 pounds per square inch and gas flow rate can be, for example, of about 0 to about 20 standard cubic feet per hour (scfh). The plenum preferably includes an outlet port for engaging a vacuum source so that the receiver vessel can be continuously evacuated while the nozzle is engaged with the receiver, and optionally while the conveyor or auger is operating, thereby promoting fill rates its by eliminating positive pressure accumulation in the receiver during a fill. The plenum communicates negative vacuum pressure from the vacuum source to the receiver and accelerates the receiver fill rate and removes any residual or stray airborne particulates thereby eliminating toner contamination and eliminating the need for an additional clean up step. The vacuum adapted plenum further enhances and ensures the anti-dribble and clean particulate flow cessation or cut-off character and operation of the apparatus. The vacuum pressure can be, for example, from about 2 to about 6 inches of water. While the apparatus can be operated satisfactorily without a vacuum assist, in preferred embodiments, vacuum is used with a negative pressure of from about 0.1 to about 10 inches of water, and more preferably from about 3 to about 5 inches of water.

The conveyor can be, for example, a spiral auger of various geometries, for example, a straight or tapered helical screw, which conveyors assists or drives the material from the source to the receiver or container. Preferably the auger closely conforms to the conduit, and preferably a portion of the auger can subtend the nozzle into the receiver.

The nozzle can optionally include a deflector operably associated with the nozzle for deflecting the particulate material as it exits the nozzle into the receiver. In an embodiment, the deflector comprises a blade attached to the conveyor.

The apparatus can include a flexible housing operably associated with the nozzle tip for urging, aligning, and conforming the nozzle tip with the receiver container.

The present invention provides in embodiments a filling apparatus comprising:

the aforementioned apparatus including a conveyor, fluidizing compression nozzle, and further comprising a second conveyor for conveying a container or receiver under the nozzle, the container being vertically spaced from the end of the nozzle; and an elevator for reversibly vertically elevating and lowering the container so that an opening in the container can engage and disengage the end or tip of the nozzle and return the container to the second conveyor when the container is filled with a material.

It will be readily appreciated by one of ordinary skill in the art that the aforementioned elevator for reversibly elevating and lowering the container from and to the second conveyor can be eliminated, or in the alternative, be reconfigured to accomplish the equivalent operative result by bringing the nozzle and the filling apparatus and associated tooling to the container. Thus, for example, the filling apparatus including the fluidizing nozzle, conduit, and associated hardware such as the auger conveyor, and optionally the associated particulate source, are lowered and brought into a fill relationship with the container and thereafter repeatedly elevated and lowered as required for each subsequent container fill operation.

The present invention also provides a method comprising:

placing a first container to be filled in filling relationship with the nozzle of the aforementioned apparatus;

rotating the conveyor thereby driving the particulate material from a source through the conduit to fill the first container with particulate material;

stopping the conveyor thereby stopping the flow of particulate material through the apparatus when the first container is filled to a predetermined value;

removing the first container; and repeating continuously the sequence of placing, rotating, stopping, and removing the filled container with an n-th container.

It will also be readily appreciated by one of ordinary skill in the art that the aforementioned apparatus, filling apparatus, and filling method, can be effectively operated and practiced without operating the fluidizing nozzle, or in the alternative, without the fluidizing nozzle being present in the apparatus. Thus the present invention embodies an apparatus comprising a conduit, a conveyor, and a liner. When it is desired to practice the present invention in the absence of the fluidizing nozzle it is preferred to select conduit openings between the auger and the receiver which are about the same or equivalent size. When the apparatus is operated without a fluidizing nozzle the particulate material, such as toner, is still capable of clumping and stopping particulate flow through the apparatus when the auger conveyor is stopped. The liner member lowers the frictional forces acting on the particulate material between the conduit wall and the operating auger conveyor thereby reducing frictional heating and consequently reducing or eliminating extensive particulate blocking.

In embodiments the n th container can be, for example, from 1 to about 10,000,000. The containers can be reliably, rapidly, and completely filled. The method and apparatus of the present invention provides toner cartridge fills, for example, with magnetic toner materials, that are substantially complete, that is, to full capacity because the fill apparatus enables fluidized transport of a dense toner mass with a high level of operator or automatic control over the amount of toner dispensed. Completely filled toner cartridges as provided in the present invention render a number of advantages, such as enhanced customer satisfaction and enhanced product perception, reduced cumulative cartridge waste disposal since there is more material contained in the filled cartridges, and reduced shipping costs based on the reduced void volumes. The particulate volume that can be filled into the containers is approximately constant, that is the same amount of fill into each container, for example, with a fill weight variance of less than about 0.1 to about 0.2 weight percent. The present apparatus and method can fill containers substantially to full capacity with little or no void volume between the particulate mass and the container and closure. The containers can be filled, for example, with from about 10 to about 10,000 grams of material at a rate of about 10 to about 1,000 grams per second, and in embodiments preferably from about 20 to about 400 grams per second. The containers can be reliably filled to within from about 0.01 to about 0.1 weight percent of a predetermined value; preferably to less than about 1 weight percent, and more preferably to less than about 0.1 weight percent of a predetermined target or specification value. A predetermined target specification value is readily ascertained by considering, for example, the volume available, volume variability of containers selected, and the relation of the desired weight fill to available volume. The amount of particulate material dispensed may be set or adjusted in the vacinity of a target value by, for example, regulating the speeds of the auger, for example, using a control algorithm in conjunction with an auger motor control circuit. Auger conveyor speeds can be, for example, from about 500 to about 3,000 revolutions per minute(rpm).

The dispensing of the particulate material from the source, for example, for use in toner or developer filling and packaging operations, it is preferred to dispense and fill by weight or gravimetrically. Alternatively, the dispensing of the particulate material from the source can be selected to be both continuous and discrete, for example, for use in toner extrusion or melt mixing applications.

The method and apparatus as illustrated herein can provide a substantially more uniform material feed thus reducing undesired variability compared to conventional auger feeders which typically feed in clumps. The present invention enables increased throughput and filling efficiency of from about 200 to about 400 percent compared with conventional auger fillers.

Although not wanting to be limited by theory it is believed that the highly reliable operation of the method and apparatus of the present invention is afforded by the synergy of controllable discharge and retention of particulate materials achieved by simultaneously agitating with an auger, fluidizing with positive gas pressure, and directing the particulate material into a receiver under negative pressure while intermittently retaining the particulate material in the apparatus by stopping the rotation of the auger conveyor. The continuous percolation of compressed air through the walls of the nozzle is also believed to contribute to the enhanced flow and fill rates of particulate material by, for example, continuously fluidizing particles in the nozzle, imparting additional exit or downward force to particles in the nozzle, and providing a purge force to the residual particles in the nozzle and just above the nozzle region after the auger has stopped rotating.

According to the present invention, and referring to FIG. 1, an embodiment of the particulate handling dispenser system 10 is shown. A hopper 12 with a supply of particulate material 16, such as a toner, surmounts conduit or funnel 18 which funnel accommodates or houses screw auger 22. The auger can be driven by for example a remotely controlled motor. Attached to at the discharge end of funnel 18 is fluidizing compression nozzle assembly 24. Apertures 32 and 34 are, respectively, air inlet and vacuum takeoff ports. Aperture 32 directs incoming compressed air pressure up to and through the gas permeable sections 33 of the nozzle wall, constructed for example from POREX® porous plastic, sintered metal oxides, or a gas permeable powdered metal. Aperture 34 channels outgoing air from the receiver 36 afforded by negative vacuum pressure acting thereon to the vacuum source and optional particulate recovery and recycling equipment(not shown). Nozzle 24 reversibly engages interchangeable receiver member 36, for example, a polyethylene toner bottle to be filled, which receiver member can be mated with the nozzle tip by a reversible mechanical elevator device as described below with reference to FIG. 2. The mating of nozzle 24 and receiver member 36 is also facilitated by flexible housing 35. Nozzle 24 can include optional deflector 37.

The auger conveyor 22 when stopped serves to "freeze", and alternatively when started serves to "liquefy" the particulate materials within the funnel 18 especially in the region of the funnel that is lined with the low friction liner 38. When auger is stopped particulates above the lined region are held in place by packing and compression forces and greatly restrict particulate movement and effectively block toner flow through the apparatus. When the auger is started particulates are again readily to flow. The operation of the auger thus acts to valve and controls the flow of particulate material through the assembly 10 and into receiver members 36. The fluidizing compression nozzle provides for and maintains rapid and continuous, but interruptible, particulate flow properties wherein the rate of the auger rotation in conjunction with the rate of air fluidization controls the relative rate of throughput of particulates when the auger is rotating. Thus the combination of the fluidizing nozzle and the low friction liner in the region immediate above the fluidizing nozzle provides high levels of particle flow with high levels of reliability even when rapidly starting and stopping flow of particulate material through the apparatus.

In embodiments, sleeve liner 38, constructed of a suitable material, preferably of a low friction, low surface tension, and low triboelectric charging material, can be incorporated into the apparatus as a liner of the funnel walls.

A particularly effective and preferred location for the liner 38 is in the conduit 18 just above the fluidizing nozzle region, and which liner provides additional enhancements in particulate flow and throughput when the system is operational. In embodiments the liner can obviate the need for additional agitation equipment which equipment was frequently required to restore flow in prior art devices.

Figure 2:
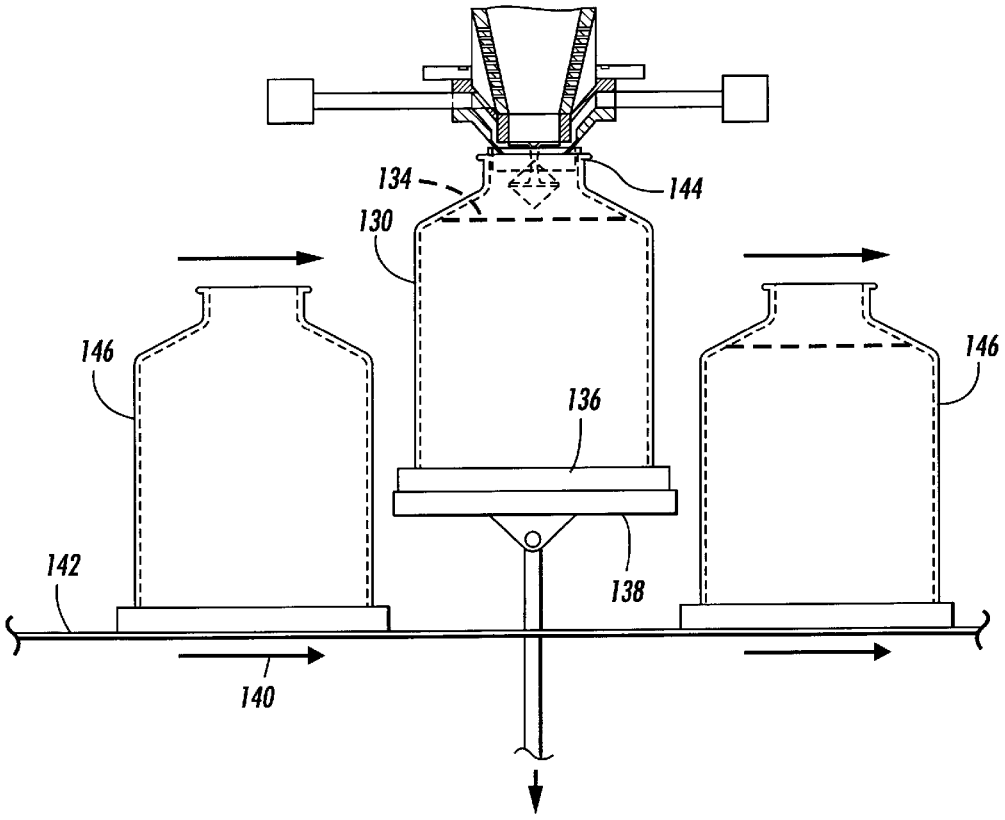
FIG. 2 shows an exemplary filling system incorporating the high speed filling apparatus of FIG. 1 in combination with a fill line.

FIG. 2 shows an exemplary filling system incorporating the high speed filling apparatus of FIG. 1 in combination with a fill line including a receiver convevor 142 and receiver elevator assembly 138, reference the aforementioned commonly owned and assigned U.S. Pat. Nos. 5,685,348 and 5,699,842, and copending application U.S. Ser. No. 08/923,016, now U.S. Pat. No. 5,921,295.

The present invention is applicable to many particulate feed, discharge, and fill operations, for example, toner fill operations and reliably combining toner and the like constituents in for example, pre-extrusion and extrusion operations. Thus, the receiver member can be selected from, for example, an extruder, a melt mixing device, a classifier, a blender, a screener, a variable rate toner filler, a bottle, a cartridge, a container for particulate toner or developer materials, and the like static or dynamic particulate receptacles. It is readily appreciated that the present invention is not limited to toner and developer materials, and is well suited for any powder or particulate material, for example, cement, flour, cocoa, herbicides, pesticides, minerals, metals, pharmaceuticals, and the like materials.

The method and apparatus of the present invention allow particulate materials including toners to be dispensed, mixed, and transported more accurately and more rapidly than prior art systems and can also insure that, for example, a melt mix apparatus or a toner container is filled accurately, quickly, cleanly, completely, and in proper proportion.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

COMPARATIVE EXAMPLE

When the apparatus substantially as shown in FIG. 1 was used to fill toner cartridges, with the exception that either or both the fluidizing compression nozzle or the liner member were absent or not operational, there were produced over about a four hour period about 1.35 cartridges/minute which were not completely full. Each cartridge contained about 1,320 grams of magnetic toner and was under weight from a target amount of about 1,360 grams with a fill weight variance of about plus or minus 40 grams or about a 3 weight percent variation. The cartridge fill rate corresponds to toner delivery from about 1,600 to about 1,700 grams of toner per minute per apparatus. An additional cleanup step was generally necessary to condition filled cartridges before they could be further packaged for shipping or used to dispense toner in a printing machine.

EXAMPLE

When the apparatus substantially as shown in FIG. 1 was used to fill toner cartridges there were continuously produced over about a four hour period about 6.3 fully filled cartridges per minute. Each cartridge contained about 1,360 grams of toner with a fill weight variance of about plus or minus 3.5 grams, that is less than about 0.25 weight percent variation from a target amount of 1,360 grams and as between different cartridges. The cartridge fill rate corresponds to toner delivery from about 8,000 to about 10,000 grams of toner per minute per apparatus. No additional cleanup step was necessary to condition the filled cartridges before further packaging or machine use.

Other modifications of the present invention may occur to those skilled in the art based upon a review of the present application and these modifications, including equivalents thereof, are intended to be included within the scope of the present invention.

What is claimed is:

1. An apparatus comprising:

a conduit operably connected to a source and extending downwardly therefrom, the conduit being adapted to permit a flow of particulate material from the source through the conduit;

a fluidizing nozzle operably connected to the conduit and extending downwardly therefrom, the nozzle defining an inlet for receiving material from the conduit and defining an outlet for dispensing material from the nozzle to an adapted receiver, the inlet defining an inlet cross sectional area perpendicular to the flow of the material and an outlet defining an outlet cross sectional area perpendicular to the flow of the material, the inlet cross sectional area being larger than the outlet cross sectional area; the nozzle being adapted with porous walls and with a plenum including an inlet port for receiving compressed gas and a chamber adapted to communicate the gas to and through the porous walls of the nozzle, and an outlet port adapted for engaging a vacuum source to continuously evacuate the adapted receiver while the nozzle is engaged with the adapted receiver;

a conveyor located at least partially within said conduit, the conveyor assisting the flow of material from the source to the receiver; and a liner member residing on to at least a portion of the inner surface of said conduit and adjacent to said nozzle.

2. An apparatus in accordance with claim 1, wherein said liner member has a low coefficient of friction of from about 0.10 to about 0.25.

3. An apparatus in accordance with claim 1, wherein said liner member further assists material flow through the apparatus.

4. An apparatus in accordance with claim 1, wherein said liner member is a fluorinated polymer.

5. An apparatus in accordance with claim 1, wherein said particulate material comprises toner particles.

6. An apparatus in accordance with claim 5, wherein said toner particles include a resin and a colorant, wherein the particles have an average particle size of from about 2 to about 50 microns.

7. An apparatus in accordance with claim 1, wherein said particulate material is a developer including toner and carrier particles.

8. An apparatus in accordance with claim 1, wherein the gas pressure is from about 20 to about 60 pounds per square inch and gas flow rate of about 0 to about 20 standard cubic feet per hour (scfh).

9. An apparatus in accordance with claim 1, wherein said vacuum is from about 2 to about 6 inches of water.

10. An apparatus in accordance with claim 1, wherein said conveyor comprises a spiral auger.

11. An apparatus in accordance with claim 1, further comprising a deflector operably associated with said nozzle for deflecting the material as it exits said nozzle into the receiver.

12. An apparatus in accordance with claim 1, further comprising a flexible housing operably associated with said nozzle for aligning and adapting said nozzle with the receiver.

13. An apparatus in accordance with claim 1, further comprising: a second conveyor for conveying the receiver under the nozzle, the receiver being vertically spaced from the end of the nozzle; and an elevator for reversibly elevating and lowering the receiver so that an opening in the receiver engages the end of the nozzle and returns the container to said second conveyor when the receiver is filled with particulate material.

14. An apparatus in accordance with claim 1, wherein the receiver is a toner cartridge.

15. An apparatus in accordance with claim 1, wherein said conduit is constructed of a material with a low coefficient of friction of from about 0.10 to about 0.25 and in lieu of said liner member.

16. A method comprising:

placing a first container to be filled in filling relationship with the nozzle of the apparatus of claim 1;

rotating the conveyor thereby driving the particulate material from a source through the conduit to fill the first container with particulate material;

stopping the conveyor thereby stopping the flow of particulate material through the apparatus when the first container is filled to a predetermined value;

removing the first container; and repeating continuously the sequence of placing, rotating, stopping, and removing the filled container with an n-th container.

17. The method in accordance with claim 16, wherein the containers are filled substantially to full capacity with substantially no void volume between the container and the particulate material mass.

18. The method in accordance with claim 16, wherein the containers are filled with said predetermined value of from about 10 to about 10,000 grams of particulate material at a rate of about 20 to about 400 grams per second.

19. The method in accordance with claim 16, wherein the containers are reliably filled to within from about 0.01 to about 0.1 weight percent of said predetermined value.

20. A method in accordance with claim 16, wherein said n-th container is from 1 to about 10,000,000.

21. A method in accordance with claim 16, wherein the containers are filled at a rate of about 200 to about 400 percent faster compared to a filling method in which the apparatus does not include either a fluidizing nozzle or a liner member.

* * * * *